US008109319B2

(12) United States Patent
Asano et al.

(10) Patent No.: US 8,109,319 B2
(45) Date of Patent: Feb. 7, 2012

(54) MOLDING PROCESS AND THE RESULTING MOLD

(75) Inventors: Norihiro Asano, Toyokawa (JP); Toshihiko Zenpo, Toyokawa (JP); Masaya Hotta, Toyokawa (JP); Kazuyuki Nishikawa, Toyokawa (JP)

(73) Assignee: Sintokogio, Ltd., Aichi-Ken (JP)

( * ) Notice: Subject to any disclaimer, the term of this patent is extended or adjusted under 35 U.S.C. 154(b) by 784 days.

(21) Appl. No.: 11/631,115

(22) PCT Filed: Jun. 29, 2005

(86) PCT No.: PCT/JP2005/011968

§ 371 (c)(1),
(2), (4) Date: Oct. 15, 2008

(87) PCT Pub. No.: WO2006/003945

PCT Pub. Date: Jan. 12, 2006

(65) Prior Publication Data

US 2009/0211725 A1 Aug. 27, 2009

(30) Foreign Application Priority Data

Jul. 2, 2004 (JP) ..... 2004-196350

(51) Int. Cl.
*B22C 9/00* (2006.01)
*B22C 1/22* (2006.01)

(52) U.S. Cl. ..... 164/15; 164/526; 523/139

(58) Field of Classification Search ..... 164/15, 164/16, 526, 522; 523/139, 145
See application file for complete search history.

(56) References Cited

U.S. PATENT DOCUMENTS

2006/0071364 A1 * 4/2006 Zenpo et al. ..... 264/219

FOREIGN PATENT DOCUMENTS

| | | |
|---|---|---|
| JP | 11-129054 | 5/1999 |
| JP | 2000-632 | 1/2000 |
| WO | WO 2004/041460 A1 * | 5/2004 |

* cited by examiner

*Primary Examiner* — Kevin P Kerns
(74) *Attorney, Agent, or Firm* — Finnegan, Henderson, Farabow, Garrett & Dunner, L.L.P.

(57) ABSTRACT

A molding process which comprises mixing together a particulate aggregate, plural kinds of water-soluble binders, a crosslinking agent causing crosslinking reaction with the binders, a phenol resin, and water, agitating the obtained mixture to prepare a bubbled fluid aggregate mixture, filling the aggregate mixture into a molding cavity, and solidifying the aggregate mixture through the evaporation of water from the mixture to give a mold made from the mixture.

14 Claims, No Drawings

MOLDING PROCESS AND THE RESULTING MOLD

THE TECHNICAL FIELD OF THE INVENTION

The present invention relates to a process for molding a mold from particle aggregates, using plural kinds of water-soluble binders as bonds. The present invention also relates to a mold produced by the method.

Recently, to get a superior mold with the ability to collapse, one method has been suggested wherein a mold is formed from granular aggregates using plural kinds of solution binders as bonds, as disclosed in, e.g., Japanese Patent Early-Publication No. 11-129054. In this method, the water-soluble binders and the granular aggregates are stirred to produce an aggregate mixture.

However, there is a problem in that the distribution of the aggregate mixture does not have an effective density when the aggregate mixture is blown and filled into a molding space. This problem is significant in a mold that has a complicated shape. Thus the corresponding molding space involves a complex profile.

Accordingly, it is desirable to provide a molding process in which a collapse-related superior mold with the ability to collapse can be produced, and in which an aggregate mixture can be blown and filled into a molding space with the density of the filling being effectively distributed.

DISCLOSURES OF THE PRESENT INVENTION

The term "granular aggregate" as used herein denotes heat resistant grains comprising one or more of quartz sand, alumina sand, Orry bottle sand, chromite sand, zircon sand, mullite sand, and various synthetic sands (or artificial aggregate materials).

The present invention provides a process for molding a mold. The process comprises:

a) mixing, stirring, and bubbling granular aggregates, plural kinds of water-soluble binders as bonds, a cross-linker that causes a bridging reaction with the water-soluble binders, and a phenolic resin, to produce a fluid aggregate mixture;

b) filling a molding space with the fluid aggregate mixture; and c) vaporizing the moisture in the filled fluid aggregate mixture such that the aggregate mixture is cured, thereby a mold from the cured aggregate mixture being produced.

Preferably, the content of water-soluble binders in the aggregate mixture is from 0.1 to 5.0 wt % per 100 wt % of the granular aggregates. This is because no mold having enough strength is provided if the content is less than 0.1 wt %, and a mold having redundant strength is produced if the content exceeds 5.0 wt %.

For example, one type of mold resulting from the process is a core to use for casting ferrous materials. After injecting molten ferrous material into the core, the water-soluble binders can be readily volatilized or disintegrated. Thus the core can be readily removed from a molded product.

Each water-soluble binder in the present invention is fusible in water of normal temperature, and is a bond that hardens by vaporizing the moisture. For example, the water-soluble binder may be a saccharide, a protein, or a resin. Preferably, the saccharide is, in particular, starch or derivative polysaccharides such as saponin, or disaccharides such as a sugar. The term saccharide denotes a simple sugar in which a pair of glucose molecules and a pair of fructose molecules are bonded. Examples of a saccharide include highly refined sugar, and granulated sugar.

Preferably, the resin is a polyvinyl alcohol having a saponification of 80-95 mol %, or its derivative, or a phenolic resin that is fusible in water of normal temperature. Although phenolic resins are typically diluted with an organic solvent, a water-soluble phenolic resin is used herein.

The polyvinyl alcohol derivative is, e.g., a polyvinyl alcohol that contains acetic acid, or a carboxyl group, a butyric acid group, or a silanol group.

The starch is, e.g., α-starch (precooked starch) that is derived from potatoes, or corn, or tapioca, or wheat, or dextrin. The starch derivative is, e.g., etherificatied starch, esterificated starch, or a bridging starch.

The water-soluble binders to use in the present invention are readily available. In particular, α-starch, dextrin, and sugars are available at a moderate price.

α-starch, dextrin or its derivative, namely, saponin, a sugar, and a polyvinyl alcohol having a saponification of 80-95 mol %, or its derivative, are soluble in water of normal temperature.

In the molding process of the present invention, preferably the content of the phenolic resin in an aggregate mixture is 0.05-0.50 wt % for the particle-aggregate of 100 wt %. Thus, preferably the resulting mold of the present invention contains a phenolic resin of 0.05-0.50 wt % for the particle-aggregate of 100 wt %. This is because no mold having enough heat resistance can be produced if the content of the phenolic resin is less than 0.05-0.50 wt % for the particle-aggregate of 100 wt %. Also, the effect of a cross-linker, as described below, is harmed, if the content of the phenolic resin exceeds 0.50 wt %.

Adding the cross-linker that results in bridging reactions with the water-soluble binders enhances mutual bonding between the particles that are coated by the water-soluble binders and thus constitute the aggregate, and causes the particles to be more tightly bound to each other. Further, there is less possibility of the water-soluble binders reacting with water molecules, thus providing the resulting mold with enough density even in a high-humidity environment.

The cross-linker that may be used in the present invention includes a compound having a carboxyl group that includes oxalic acid, or maleic acid, or succinic acid, or citric acid, or butane tetra carboxylic acid, all of which build a bridge by combining their esters. Alternatively, the cross-linker may include a methyl vinyl ether-maleic anhydride copolymer, and an isobutylene—maleic anhydride copolymer, which isobutylene—maleic anhydride copolymer has a carboxyl group when it is in the phase of a water solution. Preferably, a cross-linker building a bridge by the ester combination, that is, the cross-linker having a carboxyl group, is used, since it generates less harmful gas during the molding process or the teeming step for molten metal.

In the molding process of the present invention, preferably the added quantity of the cross-linker is to be 5-300 wt % in relation to the water-soluble binders. This is because no mold having enough density in a high-humidity environment can be produced if the added quantity of the cross-linker is less than 5 wt %, whereby the advantage of the cross-linkage reaction is insufficient. Although a resulting mold having enough density in the high-humidity environment can be produced if the added quantity of the cross-linker exceeds 300 wt %, its advantage is not more remarkable than when the added quantity of the cross-linker is 300 wt %.

It is preferable to use the cross-linker as a water solution. For example, its density may be more than 10% by weight if the cross-linker is butane tetra carboxylic acid, citric acid, or a methyl vinyl ether—maleic anhydride copolymer.

A bridging reaction in the molding process of the present invention is carried out before or after taking out the resulting mold from a molding space. If the bridging reaction occurs after the resulting mold is removed from the molding space, it should be held below 20 minutes under an atmosphere of a temperature of 220 degrees Celsius, around 10 minutes under an atmosphere of a temperature of 250 degrees Celsius, and for a shorter time under an atmosphere of a higher temperature.

As in the process of the present invention, the aggregate mixture has superior fluidity. This is achieved by stirring and bubbling the aggregate mixture to form many fine voids or bubbles.

Although the bubble fraction in the aggregate mixture varies with the quantity added to a water-soluble binder, and the quantity of water added, according to an experiment preferably 50-80% is best to obtain fluidity.

A bubble fraction (%) is defined by the following equation.

Bubble fraction(%)={Total Volume of Mixture)−(Volume of Granular Aggregate, Water-soluble binders, and Water)/(Total Volume of Mixture)}×100

Uniformly distributing bubbling air in the fluid aggregate mixture increases the fluidity of it when it is pressurized and filled in the molding space. With the bubbling, the granular aggregate flows, and is dispersed uniformly.

The means to stir and thus to bubble the aggregate mixture may in common use the stirrer that is used to mix the components of the aggregate mixture, or another stirrer. The stirrer can generate bubbling air and distribute it in the mixture.

In the filling step in the process of the present invention, the aggregate mixture is pressurized by a means of solid pressing members or compressed gas such that the molding space is filled with the aggregate mixture. In both cases, a cylinder receives the fluid aggregate mixture such that a piston (a solid pressing member) is pressurized and inserted into the cylinder to extrude the aggregate mixture from the cylinder and thus the molding space is filled with the extruded aggregate mixture. Alternatively, if the top opening of the cylinder is hermetically closed, compressed air or gas may be applied to the upper surface of the aggregate mixture within the cylinder to pressurize, it and thus the molding space can be filled with the extruded aggregate mixture, as when the piston is used.

In the process of the present invention, to vaporize moisture in the filled fluid aggregate mixture a metal die or its associated member, or both, defining the mold space, may be heated to a high temperature, or heated vapor steam or a microwave may irradiate the fluid aggregate mixture. Alternatively, the molding space that is filled with the fluid aggregate mixture may receive a vacuum drying by leaving it under a vacuum environment, or the fluid aggregate mixture in the molding space may receive a through-flow drying.

Following the metal die defining the mold space, the die is heated in a high temperature, and the bubbled fluid aggregate mixture then fills the heated metal mold to vaporize the moisture. The voids that have been distributed in the fluid aggregate material by the stirring and the moisture in the water-soluble binders are moved to the center of the mold that is made from the fluid aggregate mixture by means of the heat of the metal die. Thus, the density of the granular aggregate that fills the center of the mold is lowered. Lowering the density causes the gases generated by the decomposition of the water-soluble binders to be readily exhausted. Thus the quantities of the granular aggregate and the water-soluble binders to be used to make the predetermined mold can be reduced.

Because the heat resistance of the mold of the present invention can be enhanced by including 0.05 to 0.50% by weight of the phenol resin to 100% by weight of the granular aggregate, the mold can be used for molten metal at a temperature higher than, e.g., 1300 degrees Celsius. Such a mold is preferably adapted to be used as a core to mold ferrous metals.

Because the aggregate mixture having the enhanced fluidity can be efficiently filled in a molding space that has a complex profile, a predetermined mold can be produced.

PREFERRED EMBODIMENTS OF THE INVENTION

In the first embodiment of the molding process of the present invention a core is molded. In the first embodiment, an aggregate mixture A is prepared, as follows.

TABLE 1

| Composition (except water) of the aggregate mixture A |
|---|
| Aggregate granular material (heat-resistant grain): Silica sand (Flattery sand) 100 wt % |
| Water-soluble Binders (bonds): Polyvinyl alcohol (JP-05, made by Japan VAM Poval Co., Ltd.,) 0.3 wt %, and Starch (Dextrin NSD-L, made by Nissi Co., Ltd.) 0.8 wt % |
| Water-soluble phenolic resin: Phoenix 510 AL-2 (made by Kobe Rikagaku Kogyo Co., Ltd.) 0.3 wt % |
| Cross-linker: Citric acid (made by Fuso Chemical Co., Ltd.) 0.8 wt % |

The aggregate mixture that is composed of the composition as shown in Table 1 and water of 5 wt % are mixed and stirred with a stirrer (a desktop mixer, made by Aiko Manufacturing Co., Ltd) at 200 rpm for about 3 minutes. Thus it is caused to bubble, to prepare a fluid aggregate mixture A of about a 60% bubble fraction (the preparation step). The bubbling fluid aggregate mixture A is then poured into a cylinder. This fluid aggregate mixture is then pressurized with a piston (a solid pressurization means) such that about 80 g of it is pressure-charged into a cavity with about a 70 $cm^3$ capacity in a metal die, which is maintained at a temperature of 250° C. with, e.g., an internal cartridge heater therein (the filling step). The fluid aggregate mixture in the heated metal die is held for 90 seconds to vaporize the moisture such that the fluid aggregate is hardened (the hardening step). Thereby a core is molded.

The core then undergoes a test regarding hot water. Two molds are used: one in which one mold includes a core that is covered with an ethanol mold wash (Three Coat MTS-720A, made by Mikawakousan Co., Ltd.), while the other includes a core that is covered with no mold wash. Molten casting-iron (FC250) of 1370° C. is poured into each mold. Neither a cast defect nor a deformation can be found in a core that is not covered with any mold wash, as well as a core that is covered with the mold wash. So a resulting excellent mold can be produced and the core can be readily removed from the mold.

In the second embodiment of the molding process of the present invention an aggregate mixture B is prepared, as follows.

TABLE 2

| Composition (except water) of the aggregate mixture B |
|---|
| Aggregate granular material (heat-resistant grain): Silica sand (Flattery sand) 100 wt % |
| Water-soluble Binders (bonds): Polyvinyl alcohol (JP-05, made by Japan VAM Poval Co., Ltd.) 0.3 wt %, and Starch (Dextrin NSD-L, made Nissi Co., Ltd.) 0.8 wt % |

TABLE 2-continued

| Composition (except water) of the aggregate mixture B |
|---|
| Water-soluble phenolic resin: Phoenix 510 AL-2 (made by Kobe Rikagaku Kogyo Co., Ltd.) 0.3 wt % |
| Cross-linker: Citric acid (made by Fuso Chemical Co., Ltd.) 0.8 wt % |

The aggregate mixture that is composed of the composition as shown in Table 2 and water of 5 wt % are mixed and are stirred with a stirrer (a desktop mixer, made by Aiko Manufacturing Co., Ltd.) at 200 rpm for about 3 minutes. It thus bubbles so that a fluid aggregate mixture of about a 60% bubble fraction (the preparation step) can be prepared. The bubbling fluid aggregate mixture is then poured into a cylinder. This fluid aggregate mixture is then pressurized with a piston (a solid pressurization means) such that about 90 g of it is pressure-charged into a cavity of about a capacity of 80 $cm^3$ in a metal die, which is maintained at a temperature of 250° C. with, e.g., an internal cartridge heater therein (the filling step).

The fluid aggregate mixture in the heated metal die is held for 2 minutes to vaporize the moisture such that the fluid aggregate is hardened (the hardening step). The polyvinyl alcohol, the starch, etc., are then cross-link-reacted with the citric acid. Subsequently, the resulting mold comprising the hardened aggregate mixtures is removed from the cavity of the die. Specimens to use for a bend test method are prepared from the resulting mold. The specimens are held for 24 hours in constant-humidity baths at 98% humidity.

As a result, strengths of 5.4 MPa and 2.3 MPa were measured at a humidity of 30% and at a humidity of 90%, respectively.

Because the mold strength of 5.4 Mpa at a humidity of 30% approximately equals that of a mold that is produced from a shell molding, a normal operation involves no significant problem. If the mold has a strength of 2 Mpa after it held for 24 hours in a humidity at 98%, a normal handling of the mold involves no significant problem, and such a humidity suffices for the mold to be used.

The forgoing embodiments are intended to be illustrative, and not limiting. Those skilled in the art can appreciate that various changes and modifications that include, e.g., the alternatives described in the disclosure of the invention, in the forgoing embodiments may be introduced without departing from the spirit and scope of the invention that is set forth in the appended claims.

The invention claimed is:

1. A process for molding a mold comprising steps of:

a. mixing, stirring, and bubbling granular aggregates, plural kinds of water-soluble binders as bonds, a cross-linker that causes a bridging reaction with the water-soluble binders wherein said cross-linker is a compound having a carboxyl group, and phenolic resin in an amount from 0.05 to 0.50 wt % per 100 wt % of said granular aggregates, to produce a fluid aggregate mixture;

b. filling a molding space with said fluid aggregate mixture; and c. vaporizing moisture in said filled fluid aggregate mixture such that the aggregate mixture is cured to produce a mold from the cured aggregate mixture.

2. A process of claim 1, wherein a content of said water-soluble binders in said aggregate mixture is from 0.1 to 5.0 wt % per 100 wt % of the granular aggregates.

3. A process of claim 1 or 2, wherein each water-soluble binder is fusible in water of normal temperature.

4. A process of claim 1 or 2, wherein each water-soluble binder is selected from a group consisting of a saccharide, a polyvinyl alcohol or its derivative, and further, a phenolic resin that is fusible in water of normal temperature.

5. A process of claim 1 or 2, wherein said cross-linker is its water solution.

6. A process of claim 1 or 2, wherein said compound having the carboxyl group is selected from a group that includes an oxalic acid, a maleic acid, a succinic acid, a citric acid, a butane-tetra carboxylic acid, a methyl vinyl ether—maleic anhydride copolymer, and an isobutylene—maleic anhydride copolymer.

7. A process of claim 6, wherein said cross-linker is a cross-linker water solution in which a concentration of any of the citric acid, the butane-tetra carboxylic acid, and the methyl vinyl ether—maleic anhydride copolymer is more than or equal to 10 wt %.

8. A process of claim 1 or 2, wherein the added quantity of said cross-linker is 5 to 300 wt % in relation to said water-soluble binders.

9. A process of claim 1 or 2, wherein said fluid aggregate mixture has a bubble fraction of 50 to 80%.

10. A process of claim 1 or 2, wherein said filling step includes a step for filling said fluid aggregate mixture in said molding space by pressurizing said fluid aggregate mixture by means of a solid pressurizing means.

11. A process of claim 1 or 2, wherein said filling step includes a step for filling said fluid aggregate mixture in said molding space by pressurizing said fluid aggregate mixture with a compressed gas.

12. A process of claim 1 or 2, wherein said vaporizing step includes a step for vaporizing the moisture in said fluid aggregate mixture by means of the heat of a metal die that is heated.

13. A process of claim 1 or 2, wherein said step for vaporizing the moisture in said fluid aggregate mixture by means of the heat of said heated metal die includes a step for collecting the bubbles in said fluid aggregate mixture and the moisture in said water-soluble binders in the center of a mold to be molded such that a density of said filled fluid aggregate mixture at the center of the molded mold is lower than that at the periphery of the molded mold.

14. A process of claim 13, wherein said molded mold is a core for molding a ferrous metal.

* * * * *